US011000133B2

(12) United States Patent
Jafa et al.

(10) Patent No.: US 11,000,133 B2
(45) Date of Patent: May 11, 2021

(54) VACUUM-INSULATED COOLER

(71) Applicant: PepsiCo, Inc., Purchase, NY (US)

(72) Inventors: Emad Jafa, Brewster, NY (US); Xuejun Li, White Plains, NY (US); Cheuk Chi Lau, White Plains, NY (US); Drishti Masand, Boston, MA (US); Priscila Lazarini, Sorocaba/Säo Paulo (BR)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/586,307

(22) Filed: Sep. 27, 2019

(65) Prior Publication Data

US 2021/0095915 A1 Apr. 1, 2021

(51) Int. Cl.

| | |
|---|---|
| ***A47F 3/04*** | (2006.01) |
| ***F25D 23/06*** | (2006.01) |
| ***F25D 23/02*** | (2006.01) |

(52) U.S. Cl.

CPC ..... *A47F 3/0434* (2013.01); *A47F 3/0426* (2013.01); *F25D 23/028* (2013.01); *F25D 23/063* (2013.01); *F25D 23/065* (2013.01); *F25D 2201/14* (2013.01)

(58) Field of Classification Search

CPC .. F25D 23/063; F25D 23/065; F25D 2201/14; A47F 3/04; A47F 3/0404; A47F 3/0408; A47F 3/0426; A47F 3/043; A47F 3/0434

See application file for complete search history.

(56) References Cited

U.S. PATENT DOCUMENTS

| | | | | |
|---|---|---|---|---|
| 3,958,383 A * | 5/1976 | Dallen | E06B 3/6205 | 52/204.597 |
| 4,206,615 A * | 6/1980 | Sobajima | A47F 3/0434 | 219/218 |
| 4,660,903 A * | 4/1987 | Shinagawa | A47F 3/0434 | 312/116 |
| 4,953,362 A * | 9/1990 | Shoji | F25D 23/063 | 62/246 |
| 5,755,108 A * | 5/1998 | Ibrahim | A47F 3/0408 | 62/256 |
| 6,042,202 A * | 3/2000 | Goppion | A47F 3/005 | 292/302 |

(Continued)

FOREIGN PATENT DOCUMENTS

| | | | |
|---|---|---|---|
| DE | 19828333 A1 * | 12/1999 | A47F 3/0434 |
| EP | 0276787 A1 * | 8/1988 | F24S 80/54 |

OTHER PUBLICATIONS

International Search Report and Written Opinion of the International Searching Authority in International Application No. PCT/US2020/051559, dated Nov. 19, 2020 (11 pages).

*Primary Examiner* — Andrew M Roersma
(74) *Attorney, Agent, or Firm* — Sterne, Kessler, Goldstein & Fox P.L.L.C.

(57) ABSTRACT

A vacuum-insulated cooler for storing products. The cooler includes a housing and a storage compartment enclosed by the housing for storing products. The storage compartment includes a lower wall, an upper wall, and sidewalls extending from the lower wall to the upper wall that include vacuum-insulated glass. The storage compartment further includes a door for providing access to the products within the storage compartment.

15 Claims, 19 Drawing Sheets

(56) References Cited

U.S. PATENT DOCUMENTS

| | | | | |
|---|---|---|---|---|
| 6,052,965 | A * | 4/2000 | Florentin | A47F 3/0434 52/786.13 |
| 6,729,146 | B2 * | 5/2004 | Lucatello | A24F 25/02 426/590 |
| 6,786,562 | B2 * | 9/2004 | Obrock | C03B 23/033 211/153 |
| 6,971,250 | B1 * | 12/2005 | Imre | A47F 3/0404 312/406 |
| 7,246,470 | B2 * | 7/2007 | Beyrle | H05B 3/84 219/213 |
| 8,104,302 | B2 * | 1/2012 | Hayase | A47F 3/0426 62/246 |
| 10,393,423 | B2 * | 8/2019 | Lv | F25D 23/02 |
| 2006/0207279 | A1 * | 9/2006 | Daddis, Jr. | A47F 3/0408 62/255 |
| 2008/0024047 | A1 * | 1/2008 | Juo | F25D 23/02 312/405 |
| 2012/0043338 | A1 * | 2/2012 | Yang | F25D 25/02 220/592.02 |
| 2012/0286638 | A1 * | 11/2012 | Lee | A47F 3/043 312/405 |
| 2013/0002098 | A1 * | 1/2013 | Jafa | A47F 3/0404 312/108 |
| 2013/0214664 | A1 * | 8/2013 | Yoon | C03C 27/06 312/405 |
| 2014/0360603 | A1 * | 12/2014 | Godbole | F25D 23/02 137/565.23 |
| 2018/0164023 | A1 * | 6/2018 | Lv | F25D 23/02 |
| 2018/0164025 | A1 * | 6/2018 | Lv | F25D 23/02 |

* cited by examiner

VACUUM-INSULATED COOLER

FIELD

Embodiments described herein generally relate to a cooler having vacuum insulation. Specifically, embodiments described herein relate to a cooler that includes a storage compartment having sidewalls that include vacuum-insulated glass such that products within the storage compartment are visible from multiple sides of the cooler.

BRIEF SUMMARY OF THE INVENTION

Some embodiments described herein relate to a vacuum-insulated cooler that includes a housing, a storage compartment enclosed by the housing for storing products, wherein the storage compartment includes a lower wall, an upper wall, a plurality of sidewalls extending from the lower wall to the upper wall, wherein the plurality of sidewalls include vacuum-insulated glass, and a door for providing access to the products within the storage compartment.

In any of the various embodiments discussed herein, the vacuum-insulated glass may include a first panel separated from a second panel by a gap, wherein a vacuum is formed in the space between the first panel and the second panel. In some embodiments, spacers may be positioned in the gap between the first panel and the second panel to maintain separation of the first panel and the second panel.

In any of the various embodiments discussed herein, the plurality of sidewalls of the storage compartment may not include foam insulation.

In any of the various embodiments discussed herein, a first sidewall of the plurality of sidewalls may be connected to a second sidewall of the plurality of sidewalls by a gasket.

In any of the various embodiments discussed herein, a first sidewall of the plurality of sidewalls may have a convex curvature.

In any of the various embodiments discussed herein, the housing may include an outer panel comprising a transparent material, and the outer panel may be arranged exterior to the storage compartment.

Some embodiments relate to a vacuum-insulated cooler that includes a housing, a storage compartment enclosed by the housing for storing products, wherein the storage compartment includes a lower wall, an upper wall, a first sidewall extending from the lower wall to the upper wall that includes vacuum-insulated glass, a second sidewall extending from the lower wall to the upper wall that includes vacuum-insulated glass, such that the products within the storage compartment are visible through the first sidewall and through the second sidewall of the storage compartment, a first door for providing access to the products within the storage compartment, and a cooling unit configured to maintain the storage compartment at a predetermined temperature.

In any of the various embodiments discussed herein, the first sidewall may be perpendicular to the second sidewall.

In any of the various embodiments discussed herein, the storage compartment may include a third sidewall comprising vacuum-insulated glass.

In any of the various embodiments discussed herein, the first door may include vacuum-insulated glass.

In any of the various embodiments discussed herein, the first door may include a frame, a vacuum-insulated glass panel supported by the frame, and an outer panel that includes a transparent material arranged exterior to the vacuum-insulated glass panel.

In any of the various embodiments discussed herein, the cooler may further include a second door for providing access to the products within the storage compartment.

In any of the various embodiments discussed herein, the lower wall may include a first vent and the upper wall includes a second vent, and wherein the cooling unit circulates cooled air to the storage compartment through the first vent and the second vent.

In any of the various embodiments discussed herein, the storage compartment may include shelves, and each of the shelves may include a transparent material.

Some embodiments described herein relate to a vacuum-insulated cooler that includes a housing including a base, an upper end, and one or more outer panels, wherein each of the outer panels includes a transparent material, a storage compartment enclosed within the housing for storing products, wherein the storage compartment includes a lower wall, an upper wall, a plurality of sidewalls extending from the lower wall to the upper wall, a door for providing access to the products within the storage compartment, and a cooling unit configured to maintain the storage compartment at a predetermined temperature.

In any of the various embodiments discussed herein, the cooling unit may be enclosed within the base of the housing.

In any of the various embodiments discussed herein, the housing may further include a post extending from the base to the upper end of the housing, wherein the post supports the storage compartment.

In any of the various embodiments discussed herein, the cooler may further include a digital display arranged on a first outer panel of the one or more outer panels.

In any of the various embodiments discussed herein, the transparent material of the one or more outer panels may include polycarbonate.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
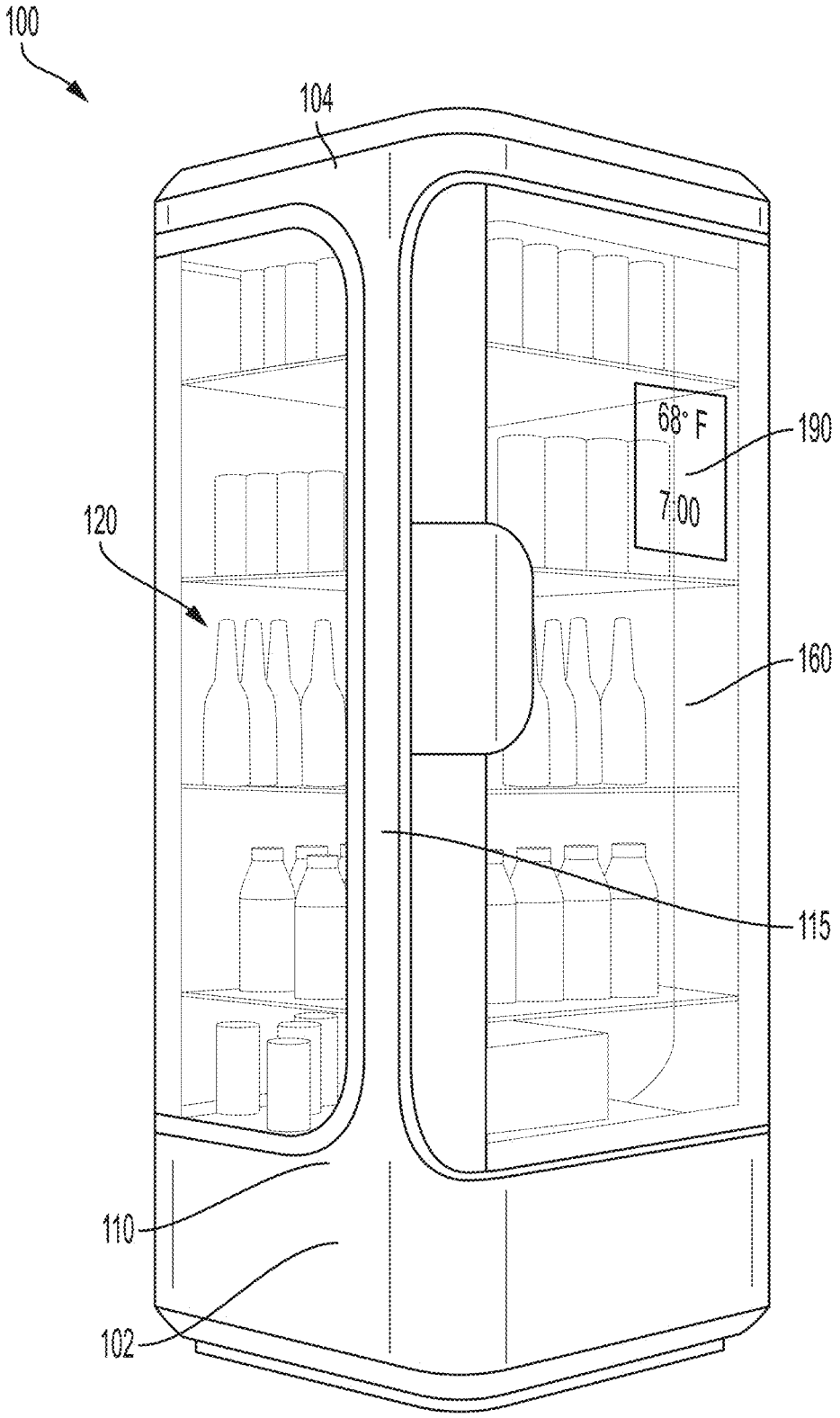
FIG. 1 shows a front perspective view of a vacuum-insulated glass cooler according to an embodiment.
Figure 2:
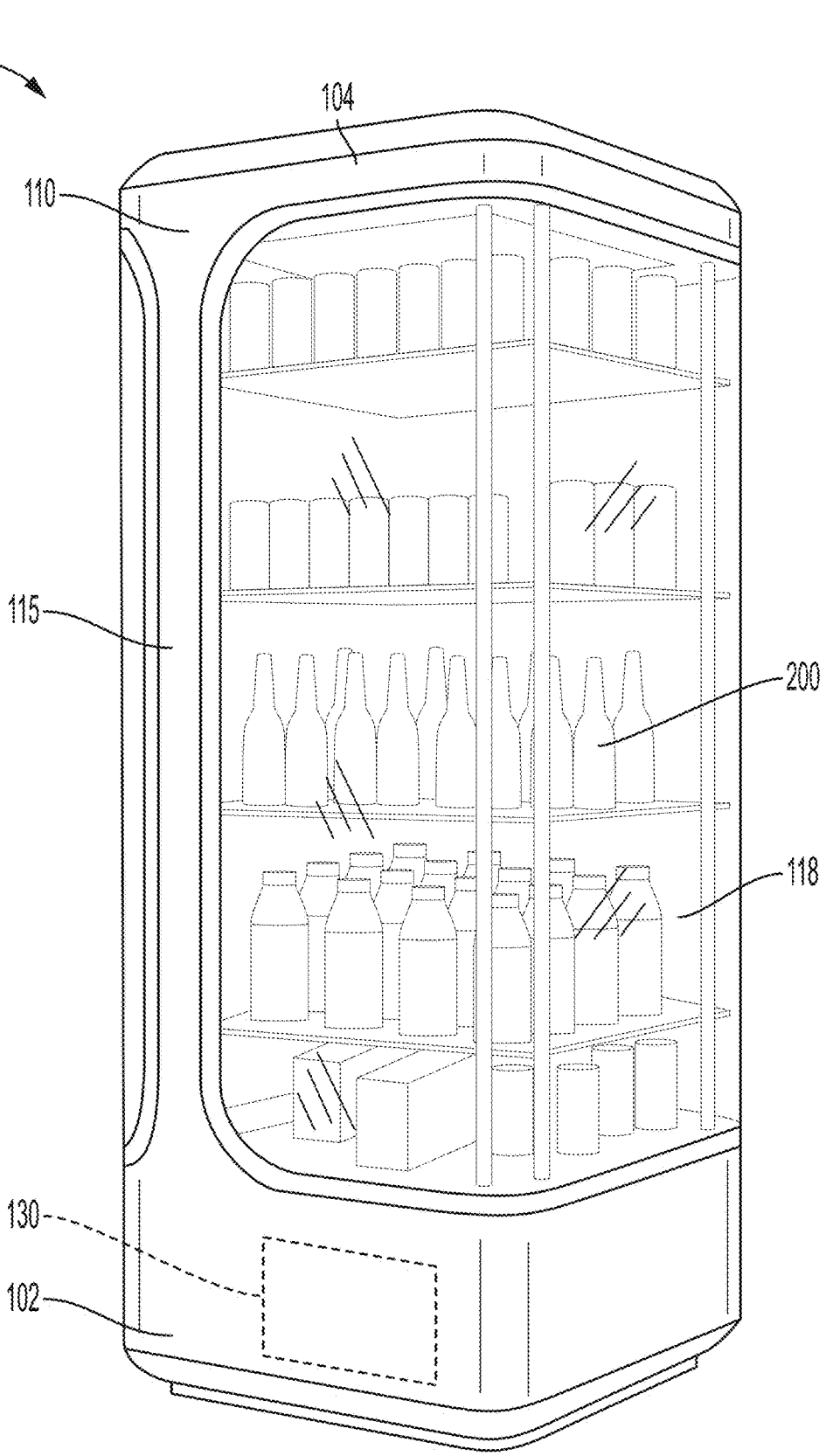
FIG. 2 shows a rear perspective view of the vacuum-insulated glass cooler of FIG. 1.
Figure 3:
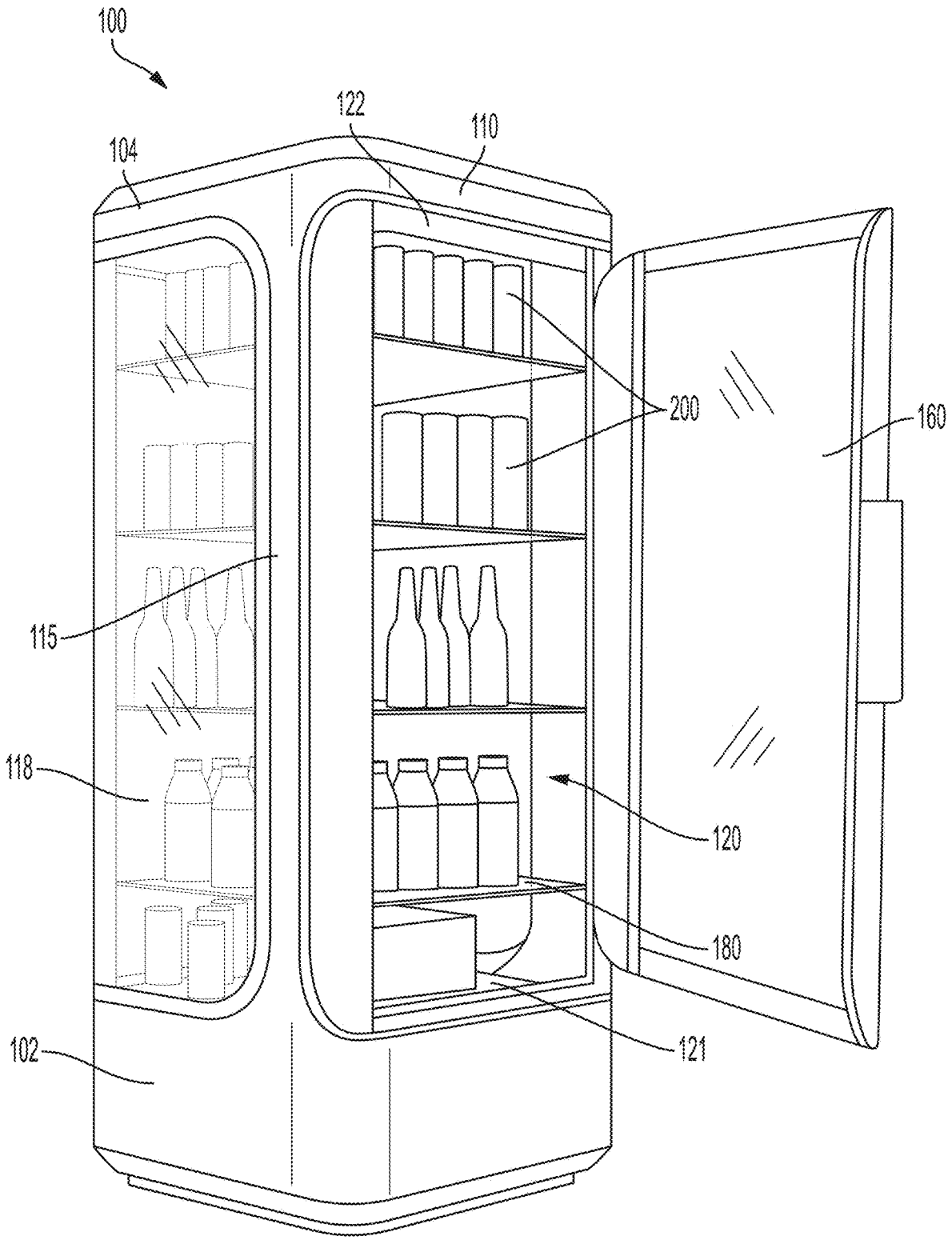
FIG. 3 shows a front perspective view of the vacuum-insulated glass cooler of FIG. 1 having a door in an open configuration.

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Commercial refrigerators and coolers for storing food and beverage items generally include a cooling unit and a storage compartment that is maintained at a predetermined temperature by the cooling unit. The storage compartment further includes thermal insulation to maintain the storage compartment at the predetermined temperature by inhibiting heat transfer into the storage compartment through the walls of the storage compartment.

Many coolers, refrigerators, and the like use a foam material, such as polyurethane foam to provide thermal insulation. The walls of the cooler are often formed by injecting the foam material between two thin metal plates. The foam is injected between the metal plates in a liquid state and the foam subsequently cures between the plates to form the housing of the refrigerator. Once the foam cures, the foam cannot be removed. The process of injecting the foam and waiting for the foam to cure can be time consuming. Further, the foam can be injected incorrectly, resulting in poor insulation and rendering the cooler unusable. In order to properly perform the injection process, the walls of the cooler are generally formed by skilled workers. Since the injected and cured foam cannot be removed from the housing, the process of recycling the cooler at the end of its useful life is difficult. Generally, the cooler must be shredded to separate the foam from the metal plates, which is time-consuming and labor-intensive.

The use of foam insulation also presents constraints on the design of the cooler. The foam insulation is opaque, and as a result any portion of the cooler that includes the foam insulation is opaque. Thus, the interior volume of the cooler is not visible through portions of the cooler having foam insulation. Many existing coolers include a rectangular housing having a rear wall and a pair of opposing sidewalls that include foam insulation, and an open front wall of the cooler includes a glass door through which the interior of the cooler can be viewed by consumers. As a result, consumers may only be able to view products within such coolers when standing directly in front of the cooler.

Some embodiments described herein relate to a cooler that includes vacuum-insulated glass. The use of vacuum-insulated glass allows a cooler to be formed with multiple transparent surfaces so that the storage compartment and products therein can be viewed from multiple sides of the cooler, e.g., two or more of a front side, a left side, a right side, and a rear side of the cooler. Further, as the cooler is insulated without the use of foam insulation that is permanently affixed to the cooler housing, the cooler can be easily assembled and subsequently disassembled, and one or more components of the cooler can be individually replaced.

Some embodiments described herein are directed to a cooler 100 that includes a housing 110 that supports and encloses a storage compartment 120 for storing products 200, as shown for example in FIGS. 1-4. Housing 110 of cooler 100 may include a base 102, outer panels 118, and an upper end 104. Storage compartment 120 of cooler 100 may include a lower wall 121, an upper wall 122, and sidewalls 124 extending from lower wall 121 to upper wall 122. Sidewalls 124 of storage compartment 120 may include vacuum-insulated glass panels 140 to provide thermal insulation, and as vacuum-insulated glass panels 140 are transparent, products 200 within storage compartment 120 may be viewed from various sides of cooler 100. Cooler 100 further includes a cooling unit 130 enclosed by housing 110, such as within a base 102 of housing 110 below storage compartment 120. Cooling unit 130 provides cooled air to storage compartment 120 for maintaining storage compartment 120 at a predetermined temperature.

Cooler 100 may be installed or positioned for use in any of various locations, such as in a shopping mall, a grocery store, an airport, a lounge, a restaurant, a bar, a movie theater, or a sports venue, among other locations. As cooler 100 includes multiple sidewalls 124 that are transparent, products 200 may be viewed from various sides of cooler 100, e.g., from a front side, a left side, a right side, and a rear side. In some embodiments, storage compartment 120 can be viewed from 360 degrees around cooler 100. Cooler 100 may be positioned centrally within a room, and can be spaced from a wall to allow products to be viewed from various sides of cooler 100. As a result, cooler 100 may be positioned in a more prominent location that is more visible by consumers in the nearby area. Further, cooler 100 allows products 200 to be viewed from multiple angles, increasing the visibility of the products by consumers, who may view the products from various locations around cooler.

Cooler 100 may be used to store any of various products, including canned or bottled beverages, such as water, carbonated water, soda, sports drinks, energy drinks, juice, dairy products, coffee, tea, or iced tea, among other beverages, and may further be used to store food, such as chips, pretzels, cookies, candy bars, energy bars, protein bars, granola bars, sandwiches, yogurt, fruit, and vegetables, among other food items. Cooler 100 may be maintained at a predetermined storage temperature by a cooling unit 130, as discussed in further detail herein, and thus cooler 100 is particularly suited for storing perishable products or for storing products at a cooled or chilled temperature so that the stored product is ready for consumption. However, one of ordinary skill in the art will appreciate that cooler 100 may be used to store any of various types of products, including non-perishable products, such as electronics or other merchandise.

In some embodiments, housing 110 of cooler 100 may include a base 102 and upper end 104, as shown in FIG. 1. Base 102 and upper end 104 of cooler 100 may be formed from opaque materials, such as a metal, e.g., aluminum, or a hard plastic. Base 102 or upper end 104 of housing 110 may enclose a cooling unit 130 (see FIG. 2) configured to provide cooled air to storage compartment 120 of cooler 100 and to maintain storage compartment 120 at a predetermined temperature for storing food and beverage items.

One or more posts 115 may extend from base 102 to upper end 104 of housing 110. Posts 115 may be integrally formed with base 102 or upper end 104, or may be separate components. Posts 115 may similarly be formed of opaque materials, such as a metal or hard plastic. Posts 115 help to provide structural support to cooler 100. Posts 115 may be hollow and may enclose conduits for carrying coiled air from cooling unit 130 to vents 191 on an upper wall of storage compartment 120, as discussed in further detail below. Further, posts 115 may provide structural support for storage compartment 120 and may be in contact with a vacuum-insulated glass panel 140 of storage compartment 120.

Housing 110 may further include one or more outer panels 118. Outer panels 118 may be secured to base 102 of housing 110, upper end 104 of housing 110, and/or posts 115 so as to provide housing 110 with a smooth and continuous exterior surface. Housing 110, including outer panels 118, defines an interior area in which storage compartment 120 is enclosed. Outer panels 118 may be formed from a transparent material so that storage compartment 120 within housing 110 can be viewed through outer panels 118 of housing 110. Outer panel 118 may serve to protect storage compartment 120 and its vacuum-insulated glass panels 140 from direct impact or contact, such as by a consumer or an object. Thus, if an object strikes cooler 100, the object will strike a portion of housing 110 rather than vacuum-insulated glass panels 140 of storage compartment 120. In some embodiments, outer panel 118 of housing 110 is composed of a strong and durable material, e.g., having high impact strength or tensile strength, and may be composed of a material that is transparent, such as polycarbonate, polymethyl methacrylate (PMMA), polyethylene terephthalate (PET), polyethylene terephthalate glycol (PETG), or glass, among others. Outer panel 118 may be curved so as to provide cooler 100 with a contoured profile. Thus, while storage compartment 120 may be formed as a rectangular prism or cube, housing 110 enclosing storage compartment 120 may have a different shape that is contoured and provides cooler 100 with a desired aesthetic appearance. In some embodiments, cooler 100 is shaped generally as a rectangular prism with rounded corners, as shown for example in FIGS. 1-4. However, cooler 100 may be formed so as to have any of various geometries, and may be shaped as a cube, a triangular prism, a cylinder, or a portion of a cone, and may have a transverse cross sectional area that is square, rectangular, circular, triangular, trapezoidal, elliptical, hexagonal, octagonal, or diamond-shaped, among others, as shown for example in FIGS. 14-19.

Figure 5:
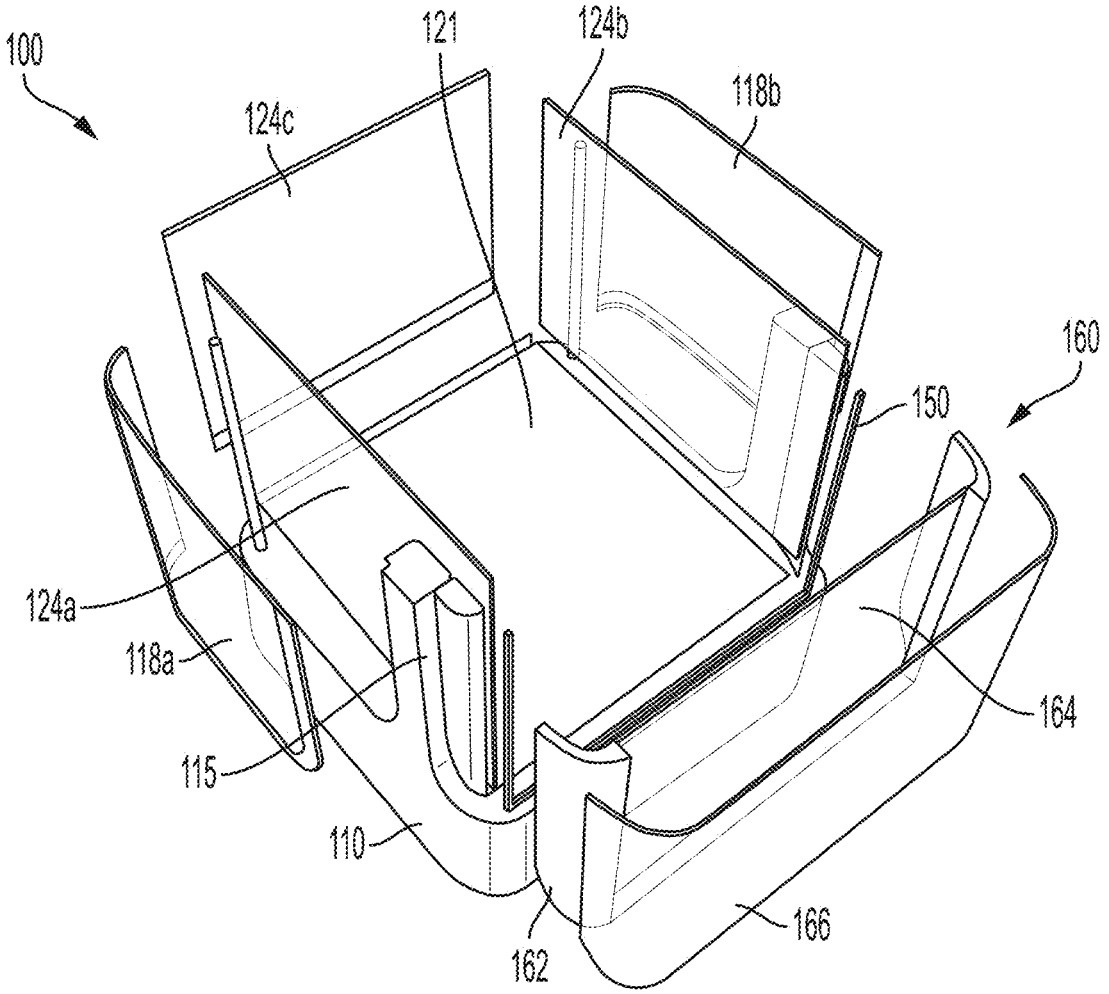
FIG. 5 shows a partial exploded view of components of the vacuum-insulated glass cooler of FIG. 1.
Figure 6:
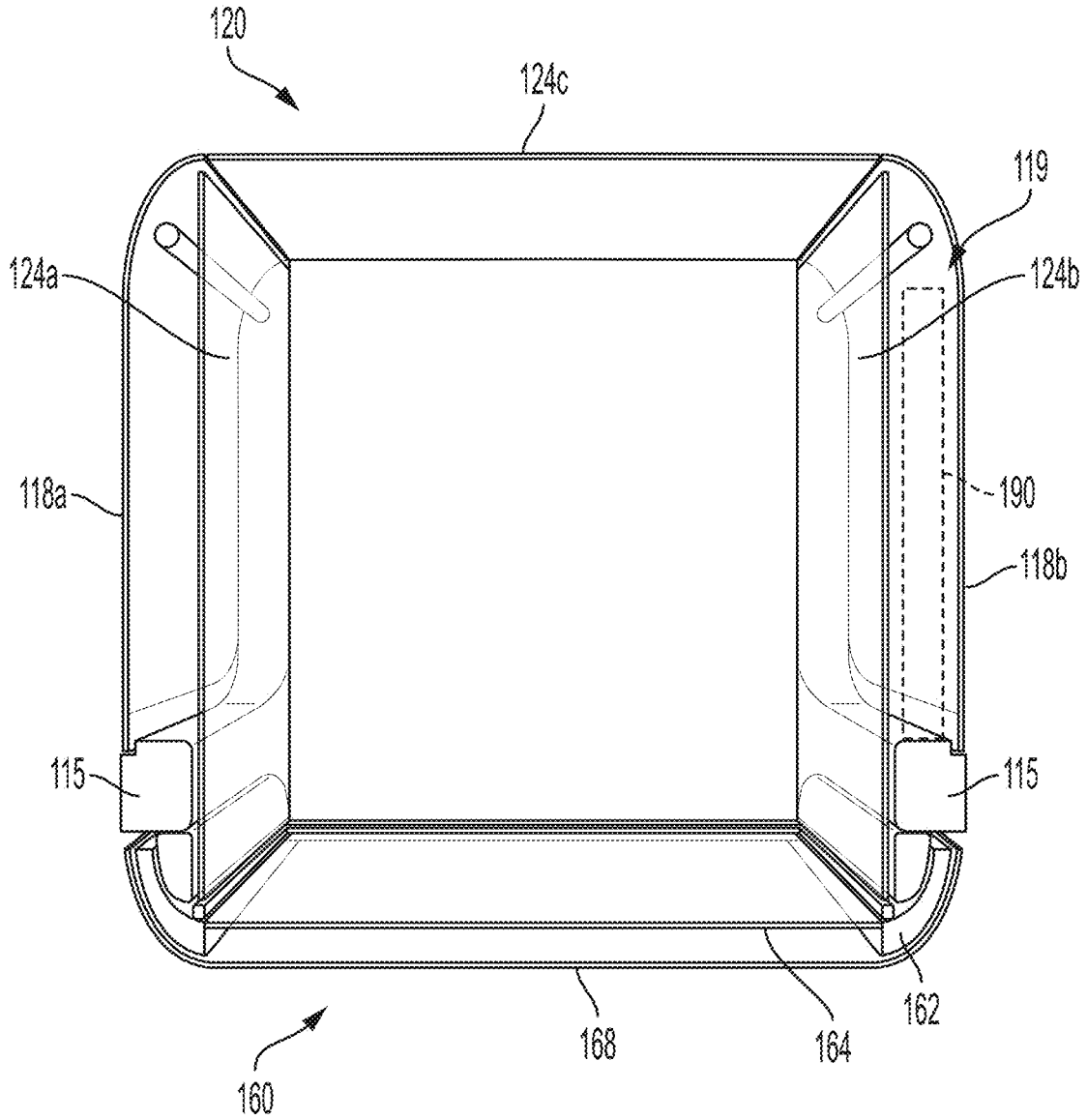
FIG. 6 shows a top-down view of a storage compartment of the cooler of FIG. 1.

Storage compartment 120 of cooler 100 includes a lower wall 121, an upper wall 122, and sidewalls 124 extending from lower wall 121 to upper wall 122 so as to define a product storage area, as best shown in FIGS. 5 and 6. In some embodiments, storage compartment 120 has a rectangular or square transverse cross sectional area. In such embodiments, storage compartment 120 includes a first sidewall 124*a*, a second sidewall 124*b* parallel to first sidewall 124*a*, and a third sidewall 124*c* connecting first sidewall 124*a* and second sidewall 124*b* such that third sidewall 124*c* is perpendicular to each of first and second sidewalls 124*a*, 124*b*. Each sidewall 124*a*, 124*b*, 124*c* may include a vacuum-insulated glass panel 140. Vacuum-insulated glass panel 140 is transparent and thus serves a dual-purpose of providing thermal insulation for storage compartment 120 while also allowing users to view products 200 within storage compartment 120 from an exterior of cooler 100 (and without opening a door 160 of cooler 100). Thus, storage compartment 120, and cooler 100 containing storage compartment 120, may be formed without foam insulation.

Figure 7:
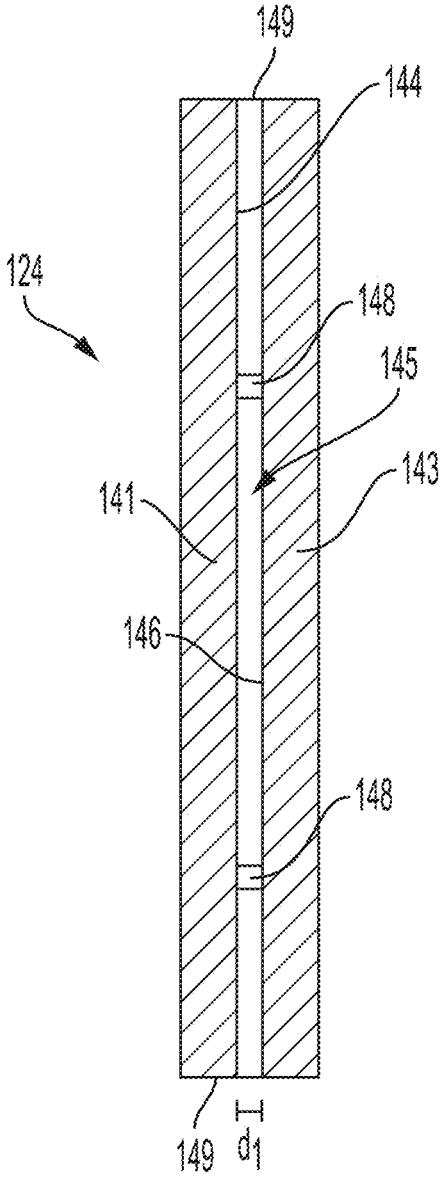
FIG. 7 shows a transverse cross sectional view of a vacuum-insulated glass panel of the cooler of FIG. 1.

Each vacuum-insulated glass panel 140 may be formed so as to have a first glass panel 141 that is spaced from and parallel to a second glass panel 143 by a gap 145, as shown in FIG. 7. First and second glass panels 141, 143 may be formed using various transparent materials, including borosilicate glass, soda-lime glass, tempered glass, or polycarbonate, among others. A vacuum is formed in gap 145 between first and second panels 141, 143. In some embodiments gap 145 between first and second panels 141, 143 may measure a distance $d_1$ of 0.1 mm to 1.0 mm, 0.2 mm to 0.6 mm, or 0.3 mm to 0.5 mm as measured in a direction perpendicular to each of first and second panels 141, 143. In some embodiments, one or more spacers 148 are positioned within gap 145 such that each spacer 148 contacts an interior surface 144 of first panel 141 and an interior surface 146 of second panel 143. Spacers 148 help to maintain separation of first panel 141 and second panel 143 along a length or height of panel 140, and also helps to provide panel 140 with increased structural stability. Spacers 148 may be formed from a metal, such as stainless steel or aluminum, or may be formed from glass. Further, first panel 141 and second panel 143 may be sealed around the perimeter edges 149 so that gap 145 is enclosed and vacuum is maintained in gap 145. Perimeter edges 149 may be sealed, for example, by an elastomeric seal or by a lead-free glass solder. While vacuum-insulated glass panel 140 is transparent to allow consumers to view products within storage compartment 120, in some embodiments, one or more of the vacuum-insulated glass panels 140 used to form cooler 100 may be formed from translucent or opaque materials so that vacuum-insulation is provided but without transparency.

In some embodiments, each vacuum-insulated glass panel 140 may be generally planar. Further, vacuum-insulated glass panel 140 may have a square or rectangular shape. However, in some embodiments, vacuum-insulated glass panels 140 may have any of various shapes, and may have a circular shape, triangular shape, oval shape, or trapezoidal shape, among others so as to form a storage compartment 120 having various geometries. Further, vacuum-insulated glass panels 140 may have a curvature, such as a convex or concave curvature. The use of curved vacuum-insulated glass panels 140 may allow storage compartment 120 of cooler 100 to be formed with a wide variety of geometries.

Figure 8:
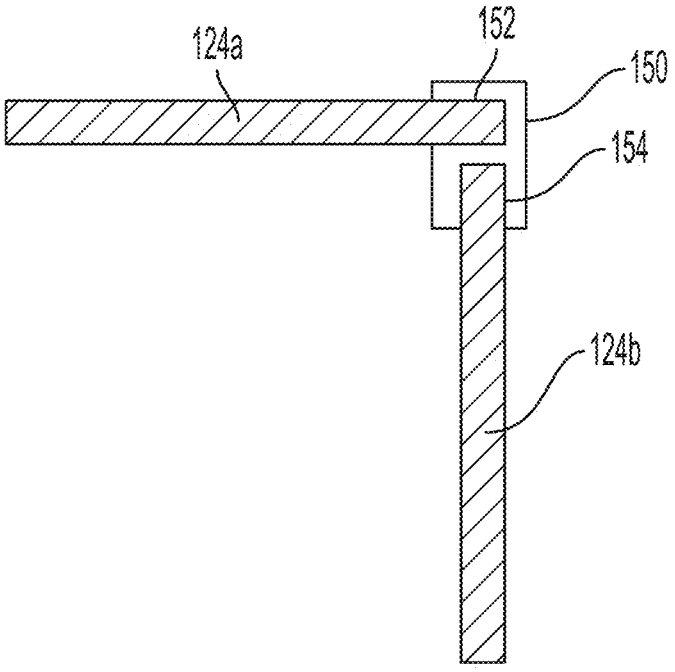
FIG. 8 shows a transverse cross sectional view of a gasket for connection of sidewalls of the cooler of FIG. 1.

In some embodiments, each sidewall 124 of storage compartment 120 may be connected to an adjacent sidewall 124 by a seal or gasket 150, as shown in FIG. 8. Gasket 150 helps to provide thermal insulation and to minimize heat transfer at an intersection of two or more sidewalls 124 of storage compartment 120 and also at an intersection of a door 160 and a sidewall 124 of storage compartment 120. Gasket 150 may be formed from an elastomeric material, such as a natural or synthetic rubber, including silicone rubber, ethylene propylene diene monomer (EPDM), polyvinyl chloride (PVC), neoprene, fluoroelastomers, such as FKM or Viton®, styrene-butadiene rubber, or nitrile rubber, among others. Gasket 150 may extend from a lower end of each sidewall 124 to an upper end of each sidewall 124 so as to extend along the entire intersection of a first sidewall 124 and a second sidewall 124. Gasket 150 may include a first channel 152 for receiving an end of a first sidewall 124, and may include a second channel 154 for receiving an end of a second sidewall 124. In some embodiments, gasket 150 may be configured to connect first and second sidewalls 124 so that they are arranged perpendicularly to one another. In some embodiments, gasket 150 may be configured to connect sidewalls so that sidewalls 124 are co-linear, or are arranged at an acute or obtuse angle. Sidewalls 124 may be inserted into channels 152, 154 of gasket 150 by an interference fit, press fit, or friction fit. However, in some embodiments, an adhesive may be used to provide additional securement of sidewall 124 within a channel 152, 154 of gasket 150.

Figure 9:
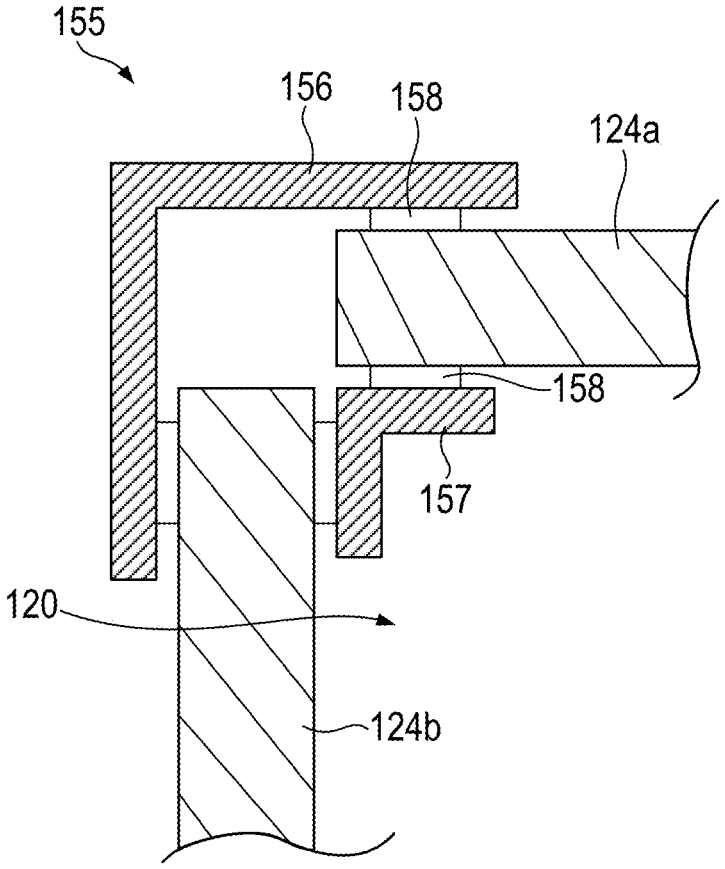
FIG. 9 shows a transverse cross sectional view of a corner element for connection of sidewalls of the cooler of FIG. 1.

In some embodiments, each sidewall 124 of storage compartment 120 may be connected to an adjacent sidewall 124 by a corner element 155, as shown for example in FIG. 9. Corner element 155 may include an interior corner 157 having an L-shape such that a first sidewall 124*a* may be connected to a first portion of interior corner 157 and second sidewall 124*b* may be connected to a second portion of interior corner 157 on an interior portion of storage compartment 120. Interior corner 157 may support first and second sidewalls 124*a*, 124*b* perpendicular to one another as shown in FIG. 9. However, interior corner 157 may be constructed so as to position first and second sidewalls 124*a*, 124*b* at any of various angles relative to one another. Interior corner 157 may be composed of a rigid material so as to provide support and stability to sidewalls 124*a*, 124*b*. First and second sidewalls 124*a*, 124*b* may be connected to interior corner 157 via bonding tape, epoxy, glue, adhesive, or sealant, or a combination thereof. In some embodiments, corner element 155 may further include an exterior corner 156. Exterior corner 156 may have an L-shape such that first sidewall 124*a* may be connected to a first portion of exterior corner 156 and second sidewall 124*b* may be connected to a second portion of exterior corner 156 on an exterior of storage compartment 120. Exterior corner 156 may be formed with an angle corresponding to an angle of interior corner 157. Thus, each sidewall 124*a*, 124*b* can be arranged between interior corner 157 and exterior corner 156. Exterior corner 156 may be composed of an insulating material so as to provide additional insulation to storage compartment 120 at an intersection of sidewalls 124*a*, 124*b*. Additionally or alternatively, exterior corner 156 may be composed of a rigid material to provide structural stability. Exterior corner 156 may be connected to sidewalls 124*a*, 124*b* via bonding tape, epoxy, glue, adhesive, or sealant, or a combination thereof.

Cooler 100 further includes a door 160 for accessing products 200 within storage compartment 120. Door 160 is movable from a closed configuration (see FIG. 1) in which storage compartment 120 is closed and products 200 therein are not accessible to consumers, and an open configuration (see FIG. 3) in which products 200 within storage compartment 120 are accessible. Door 160 may be connected to housing 110 of cooler 100 by a hinge, or door 160 may be slidably positioned on a track so that door 160 is movable from the closed configuration to the open configuration by sliding on the track. Door 160 may serve as a wall of storage compartment 120 so as to enclose storage area of storage compartment 120. Thus, in embodiments of storage compartment 120 having a rectangular configuration, door 160 may serve as the fourth sidewall and may extend between first sidewall 124*a* and second sidewall 124*b* and parallel to third sidewall 124*c*, when door 160 is in the closed configuration.

Figure 4:
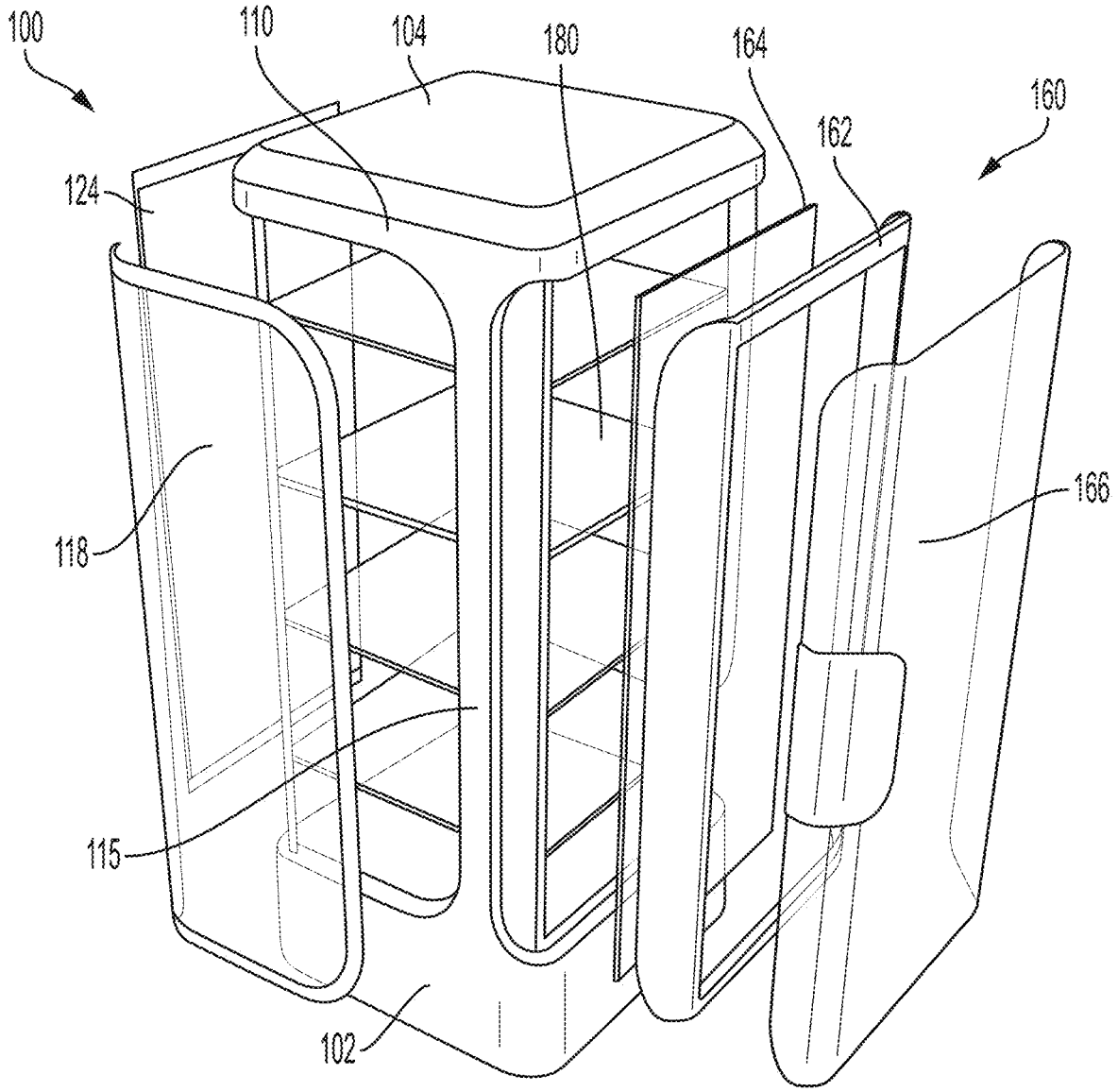
FIG. 4 shows an exploded perspective view of the vacuum-insulated glass cooler of FIG. 1.

Door 160 may include a frame 162 that supports a vacuum-insulated glass panel 164, as best shown in FIGS. 4 and 6. Vacuum-insulated glass panel 164 of door 160 may be formed in the same manner as discussed above with respect to vacuum-insulated glass panel 140 and as shown in FIG. 7. Vacuum-insulated glass panel 164 may have a generally rectangular configuration, and frame 162 extends along a perimeter or border of vacuum-insulated glass panel 164. Frame 162 may be composed of a hard plastic material. Frame 162 may incorporate a hinge for connection of door 160 to storage compartment 120. In some embodiments, door 160 may further include an outer panel 166. Outer panel 166 may be disposed on frame 162 exterior to vacuum-insulated glass panel 164. Outer panel 166 may be formed in a similar manner as discussed above with respect to outer panels 118 of housing 110. Thus, outer panel 166 may be composed of a transparent material so that door 160 is transparent and allows consumers to view products 200 within storage compartment 120 when door 160 is in a closed configuration (see FIG. 1). For example, as shown in FIG. 6, outer panel 166 is curved so as to match a curvature of frame 162 and provide cooler 100 with rounded corners. In some embodiments, outer panel 166 may be shaped so as to have a convex or concave curvature.

In some embodiments, cooler 100 may be formed so as to have multiple doors 160. In this way, storage compartment 120 and products 200 therein may be accessible from various sides of cooler 100. Additionally, the use of multiple doors 160 allows multiple consumers to use cooler 100 simultaneously. Multiple doors 160 may also provide a consumer with easier access to a particular product within storage compartment 120. Rather than reaching into storage compartment 120 to retrieve a distant product, consumer may open a door 160 closest to a desired product 200 to more easily access the product. In one embodiment, for example, doors 160 may be positioned on a front side and an opposing rear side of cooler 100. Alternatively, doors 160 may be positioned on adjacent sidewalls, such as a front side of cooler and a left or right side of cooler 100. Further, cooler 100 may include two doors 160 on one side of housing 110, such as an upper door and a lower door or a left and right door, rather than a single door (see e.g., FIG. 18).

In some embodiments, cooler 100 further includes a digital display 190, as shown for example in FIG. 6. Digital display 190 may be mounted on an outer panel 160 in a space 119 between an outer panel 118 and a sidewall 124*b* of storage compartment 120. Digital display 190 may be a liquid crystal display (LCD), a light emitting diode (LED) display, or an organic LED (OLED) display, among others. Digital display 190 may be used to display advertisements, promotions, images or videos relating to products available for sale, and messages to attract the attention of consumers. Further, digital display 190 may be a touch-screen display so that digital display 190 may serve as a user interface for receiving a user input and controlling operation of a product vending operation. In such embodiments, digital display 190 may control operation of cooler 100 and may be configured to receive a user input, such as to receive a payment and to unlock a door 160 of cooler 100 to provide a consumer with access to products 200 within cooler 100 for purchase.

Figure 10:
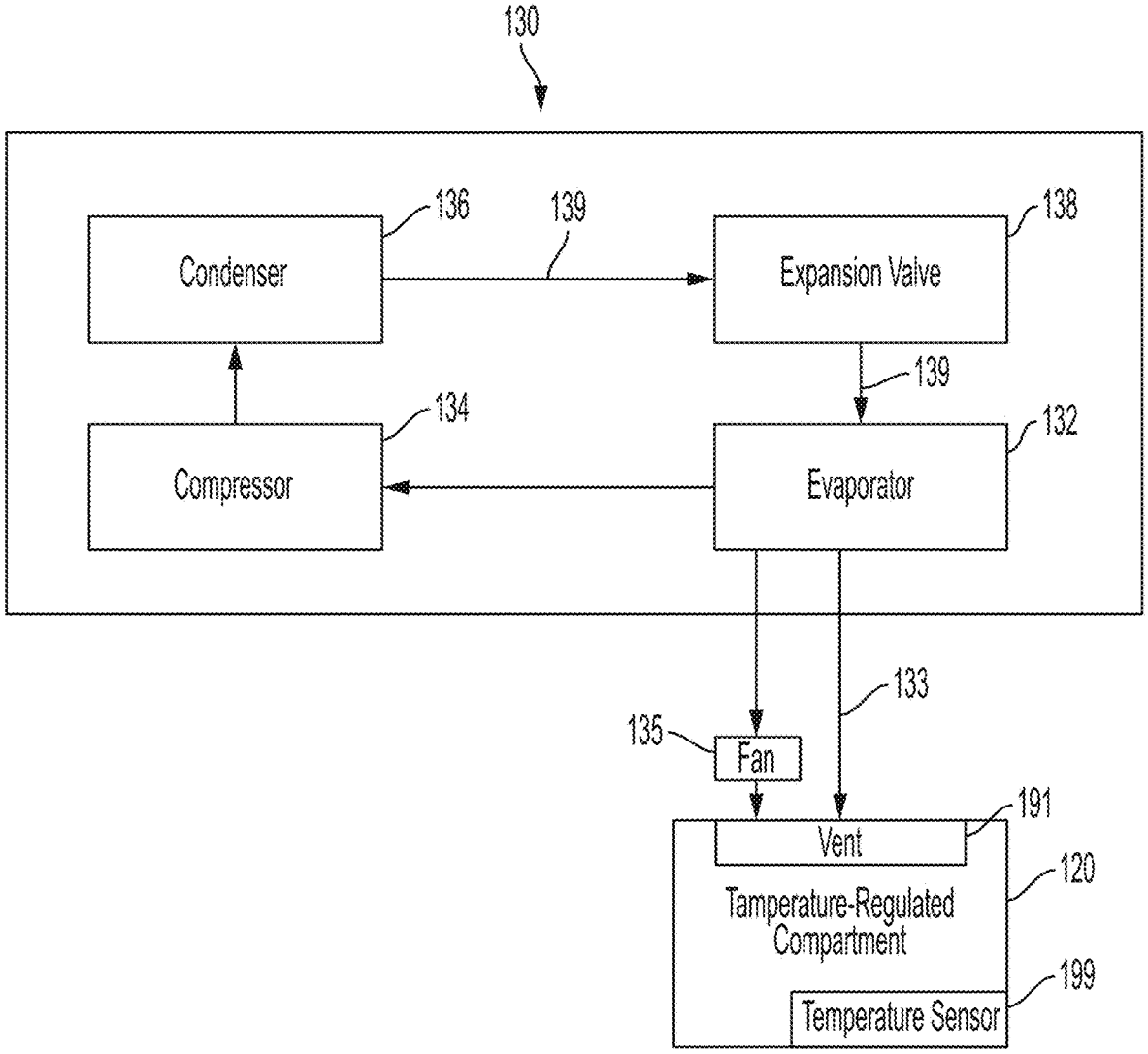
FIG. 10 shows a schematic diagram of components of a cooling unit of a cooler according to an embodiment.

In some embodiments, cooler 100 further includes a cooling unit 130 configured to maintain storage compartment 120 at a predetermined temperature, as shown for example in FIG. 10. The predetermined temperature may be for example, 33° F. degrees to 45° F. degrees. In an embodiment, cooling unit 130 may be a vapor-compression cooling unit, as shown in FIG. 10. Cooling unit 130 may include an evaporator 132 that is in communication with a compressor 134, a condenser 136, and an expansion valve 138 via a plurality of conduits 139 for circulating a refrigerant. Evaporator 132 supplies cooled air through ducts 133 to storage compartment 120. Storage compartment 120 may include vents 191 through which cooled air can flow from evaporator 132 through ducts 133 and into storage compartment 120. Ducts 133 may further be connected to fans 135 for promoting circulation of cooled air within storage compartment 120. In some embodiments, storage compartment 120 may include one or more temperature sensors 199 to determine a temperature within storage compartment 120. In alternate embodiments, other types of cooling units 130 may be used, such as a thermoelectric cooling unit, among others.

Figure 11:
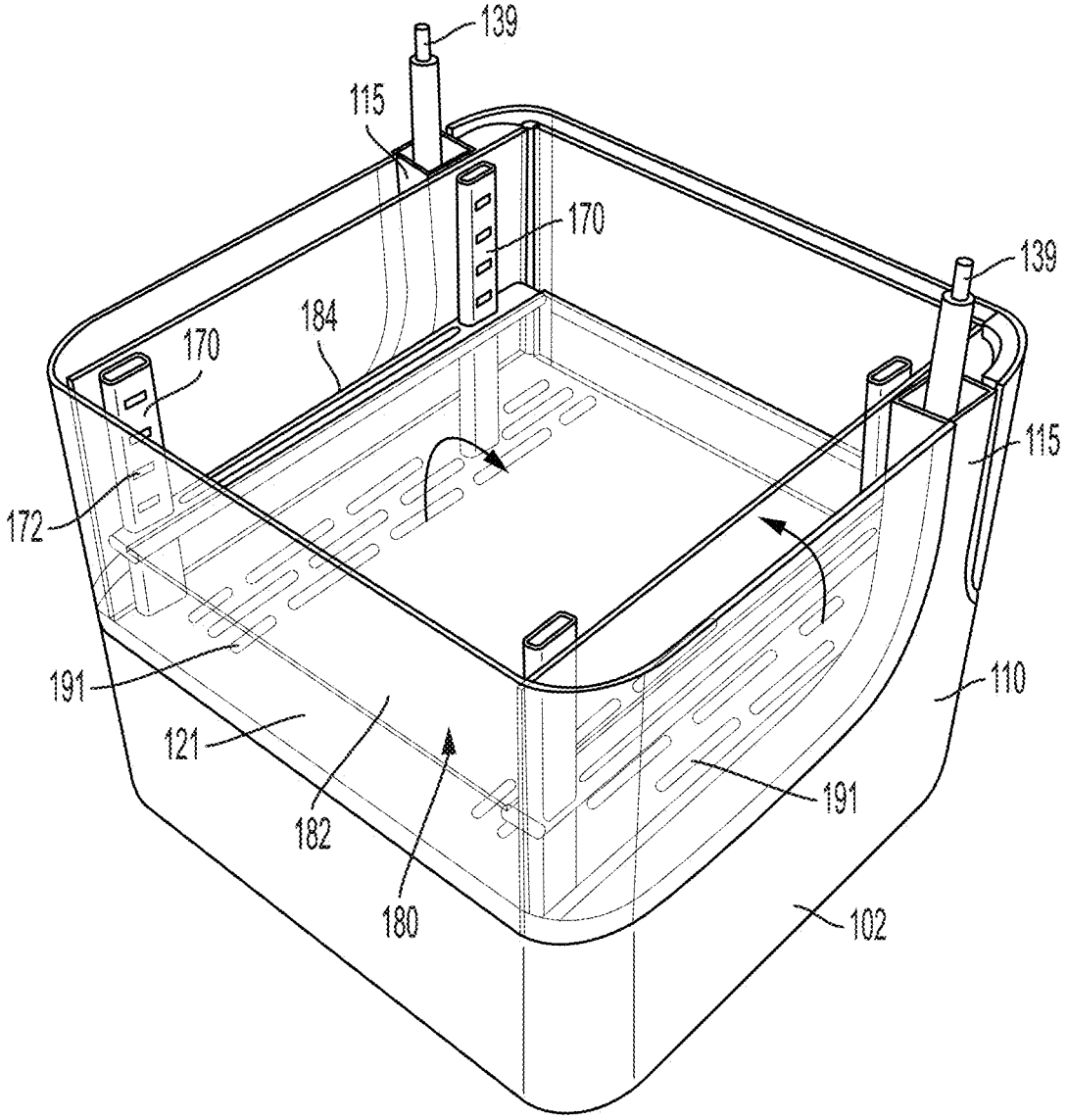
FIG. 11 shows a partial perspective view of the cooler of FIG. 1 illustrating airflow into the storage compartment.
Figure 12:
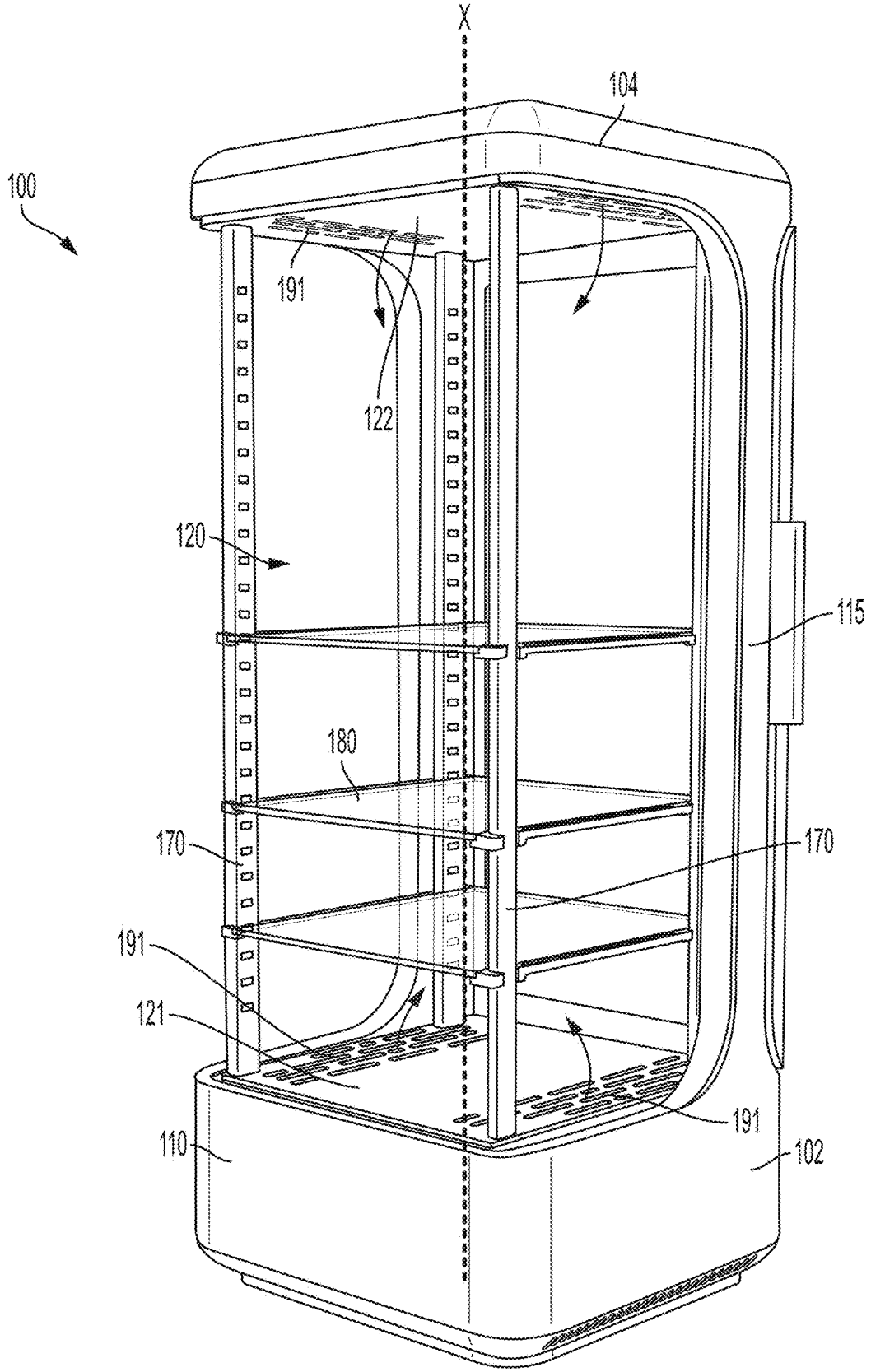
FIG. 12 shows a perspective view of a portion of the cooler of FIG. 1 illustrating airflow into the storage compartment.

Storage compartment 120 of cooler 100 includes one or more vents 191 for circulating cooled air into storage compartment 120 from cooling unit 130, as shown in FIGS. 11 and 12. Vents 191 may be positioned on a lower wall 121 of storage compartment 120. In some embodiments, vents 191 may alternatively or additionally be positioned on an upper wall 122 of storage compartment 120. In this way, cooled air from cooling unit 130 may be circulated into storage compartment 120 from both an upper end and a lower end of cooler 100. This may help to prevent formation of temperature gradients or "hot spots" within cooler 100 in which different portions of storage compartment 120 are different temperatures due to insufficient circulation of cooled air.

In some embodiments, posts 115 of housing 110 may be hollow so that a conduit 139 of cooling unit 130 can extend through post 115 to upper end 104 of housing 110, as shown in FIGS. 11 and 12. In this way, conduit 139 is hidden from view and conduit 139 does not interfere with the visibility of products 200 within storage compartment 120. Conduit 139 can supply cooled air from cooling unit 130 to vents 191 located on upper wall 122 of storage compartment 120, as shown in FIG. 12. Accordingly, cooled air may be supplied to storage compartment 120 through vents 191 arranged on lower wall 121 and upper wall 122 of storage compartment 120. Vents 191 arranged on upper wall 122 may help to ensure that products 200 at an upper end of storage compartment 120 remote from vents 191 on lower wall 121 are adequately cooled.

Figure 13:
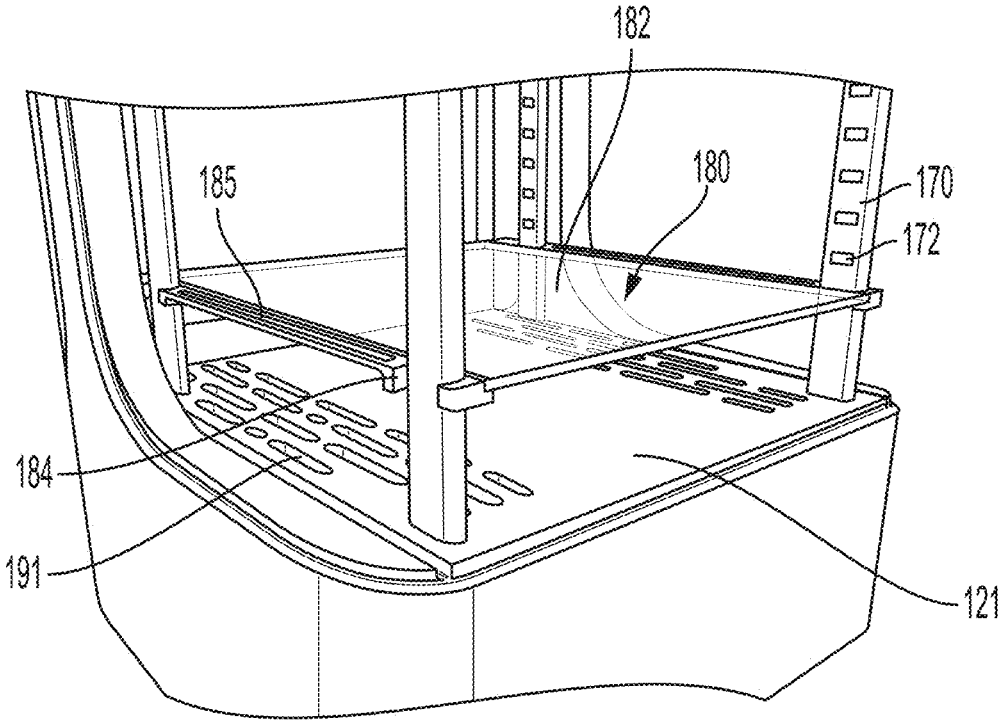
FIG. 13 shows a partial perspective view of a lower wall of a storage compartment of the cooler of FIG. 1.

In some embodiments, as shown in FIGS. 11-13, storage compartment 120 may further include one or more shelf supports 170 for supporting shelves 180 within storage compartment 120. Shelf supports 170 may extend from lower wall 121 toward upper wall 122 of storage compartment 120. A lower end 171 of shelf support 170 may be secured to lower wall 121 and an upper end 173 of shelf support 170 may be secured to upper wall 122 of storage compartment 120. Shelf support 170 may extend parallel to a longitudinal axis X of storage compartment 120 (see FIG. 12), and of cooler 100. Shelves 180 may be removably secured to shelf support 170 along a height of shelf support 170 so that shelves 180 are arranged at different elevations within storage compartment 120.

In some embodiments, shelf support 170 includes an elongated rod having a series of slots 172 spaced along shelf support 170 from a lower end 171 of shelf support 170 connected to lower wall 121 to an upper end 173 of shelf support 170. Slots 172 of shelf support 170 are configured to engage with connectors 186 of a shelf 180 in order to removably secure shelves 180 at a desired height along shelf support 170.

In some embodiments, a shelf support 170 may be positioned at each corner of storage compartment 120, as shown for example in FIG. 12. When storage compartment 120 has a square transverse cross sectional shape, four shelf supports 170 may be arranged in storage compartment 120 with one shelf support 170 in each corner. In some embodiments, a single shelf support 170 may be positioned centrally within storage compartment 120, as shown for example in FIG. 14. In such embodiments, each shelf 180 may include an aperture to receive shelf support 170 therethrough. Aperture may be arranged centrally on shelf 180. Shelf 180 can be secured at a desired height or elevation along shelf support 170 by securing shelf 180 to shelf support 170. As discussed above, shelf 180 may include a connector 186 for connecting to shelf support 170, such as a slot 172 of shelf support 170. Alternatively, shelf 180 may be secured to shelf support 170 using one or more fasteners, such as a screw, bolt, or the like.

Shelves 180 of storage compartment 120 facilitate organization and display of products 200. Shelf 180 may include a panel 182 that is generally planar, as shown in FIG. 13. Panel 182 may be formed from a transparent material, such as glass. Forming shelves 180 of a transparent material helps to allow consumers to see through storage compartment 120 and promote visibility of products 200. In some embodiments, shelf 180 may further include a border 184 extending along one or more perimeter edges of panel 182. In some embodiments, border 184 may entire around a perimeter of panel 182. Border 184 may include connectors 186, such as a hook or protrusion, configured to engage with shelf supports 170, and particularly to slots 172 of shelf supports 170. Conversely, in some embodiments, shelf support 170 may include connectors configured to engage with slots on shelf 180. In some embodiments, border 184 may extend along two opposing sides of shelf 180. Further, border 184 may include slots 185 configured to promote airflow through shelves 180. As shelves 180 may be provided as solid panels, shelves 180 block airflow within storage compartment 120, and including slots 185 in shelves 180 helps to promote airflow through shelves 180. In some embodiments, slots 185 may be included in panel 182 of shelf 180 instead of, or in addition to slots 185 in border 184. Shelf 180 may define slots 185 having any of various shapes, such as a square, rectangular, circular, elliptical, or triangular shape, among others. In some embodiments, panel 182 may be formed as a wire panel in order to further promote airflow through shelves 180.

In some embodiments, shelf 180 may include a stepped configuration so that products may be positioned on shelf 180 at different elevations. Shelf 180 having a stepped configuration may help to promote visibility of products 200 located behind other products, such as products located toward a center portion or rear portion of storage compartment 120.

In order to form cooler 100, components of cooler 100 may be transported in a disassembled state to a desired location for installing cooler 100. The components of cooler 100 may be assembled at the installation site. As cooler 100 does not require injection of foam insulation into a housing, cooler 100 can be assembled by unskilled workers. Further, if after installing cooler 100 it is desired to relocate or remove cooler 100, cooler 100 can be disassembled since cooler 100 does not include cured foam or other components that are permanently joined. As a result, cooler 100 can be quickly and easily transported from one location to another.

Further, the components of cooler 100 are not permanently secured together, and as a result the individual components of cooler 100 may be replaced if broken or damaged. For example, if a vacuum-insulated glass panel 140 cracks, the single vacuum-insulated glass panel can be removed and replaced. The ability to replace individual components allows cooler 100 to be repaired more rapidly, and may help to extend the usable life of cooler 100.

While embodiments described herein primarily relate to an embodiment of cooler 100 shaped as a rectangular prism, cooler 100 and storage compartment 120 thereof may be formed so as to have any of various geometries. The use of vacuum-insulated glass panels 140 allows cooler to be formed with any of a variety of geometries and allows products to be viewed from various sides of the cooler.

Figure 14:
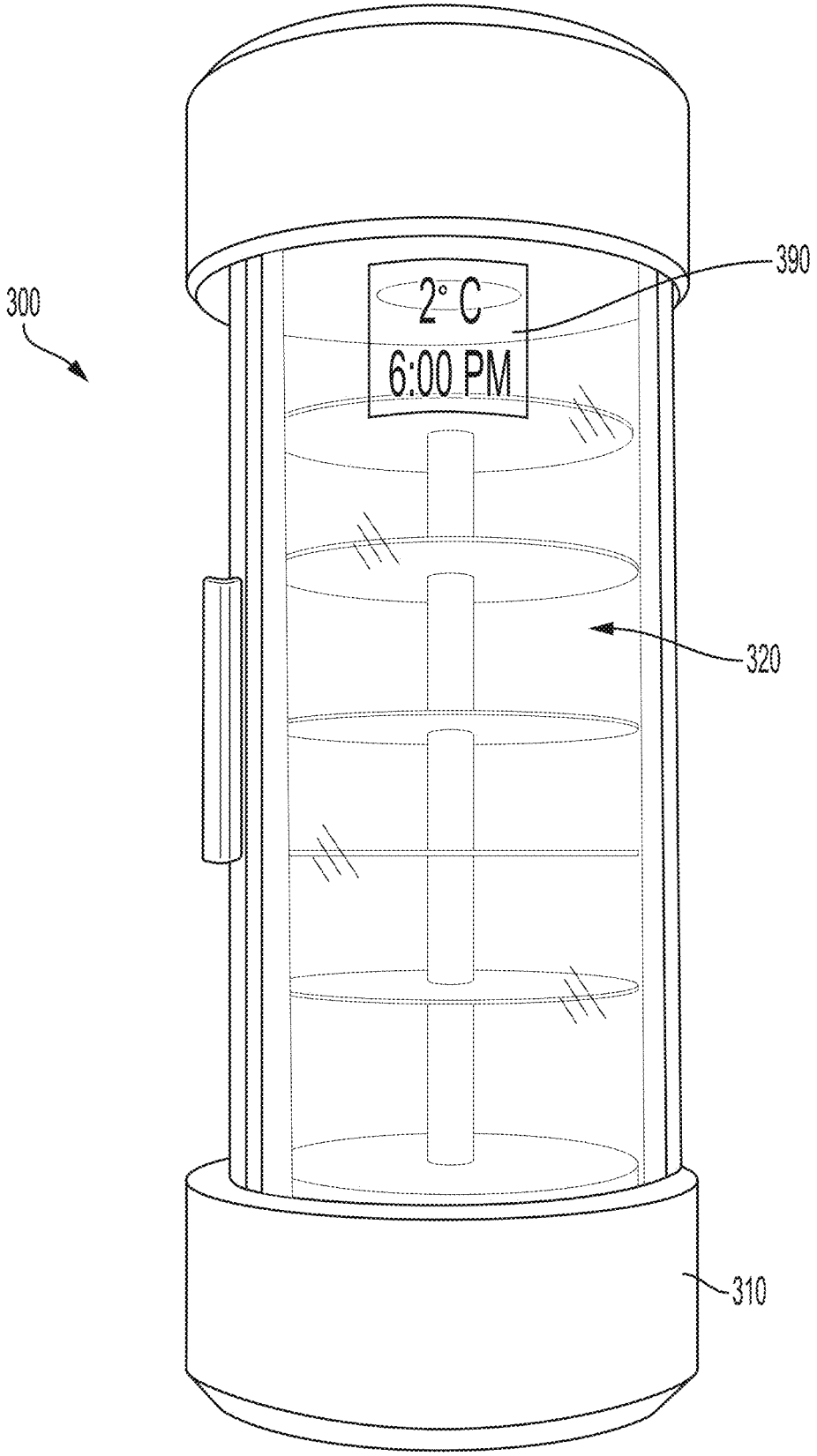
FIG. 14 shows a perspective view of a vacuum-insulated glass cooler according to an embodiment.

In some embodiments, as shown for example in FIG. 14, a cooler 300 may be formed as described herein, wherein cooler 300 has a cylindrical shape. Thus, housing 310 of cooler 300 has a circular transverse cross sectional area. In such embodiments, storage compartment 320 may include a sidewall formed from a vacuum-insulated panel that is curved along an arc of a circle, and a door for accessing storage compartment 320. Storage compartment 320 may be formed from multiple vacuum-insulated panels. For example, storage compartment 320 may include a first sidewall formed as a semi-circle, and a door formed as a semi-circle to complete the circle. Door may be connected to housing 310 of cooler 300 on tracks so that door can slide to open, and door may slide by rotating about a longitudinal axis of cooler 100. Door may alternatively be connected to housing via a hinge so that door rotates outwardly from housing 310. Further, in embodiments having a cylindrical shape, cooler 300 may include a single shelf support that is centrally located with a plurality of circular shelves arranged along the shelf support. As discussed above with respect to housing 110 of cooler 100, housing 310 of cooler 300 may include transparent outer panels exterior to and spaced from storage compartment 320. A digital display 390 may be arranged on an outer panel of housing 310 for displaying information and advertisements to consumers.

Figure 15:
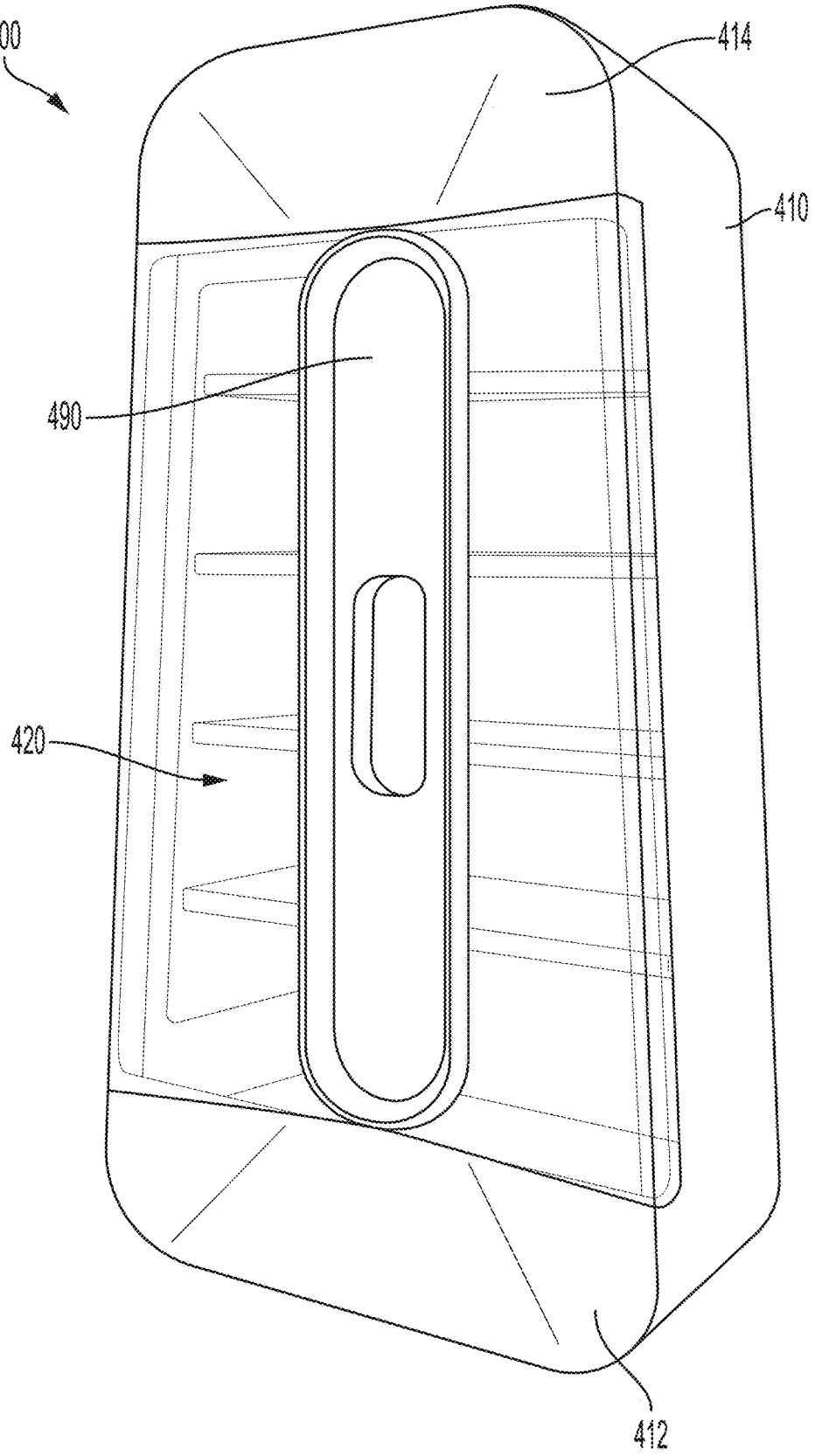
FIG. 15 shows a perspective view of a vacuum-insulated glass cooler according to an embodiment.

In some embodiments, cooler 400 may have a trapezoidal shape when viewed from the front (or when viewed from the rear), as shown for example in FIG. 15. Cooler 400 includes a housing 410 that tapers from a lower end 412 toward an upper end 414 such that a front sidewall and a rear sidewall each have a trapezoidal shape. One or more sidewalls of cooler 400 may be formed from vacuum-insulated glass so that products within cooler 400 are visible from multiple sides of cooler 400, such as from a front, a rear, a left and a right side of cooler 400. Cooler 400 may include a digital display 490 for displaying information and advertisements to consumers.

Figure 16:
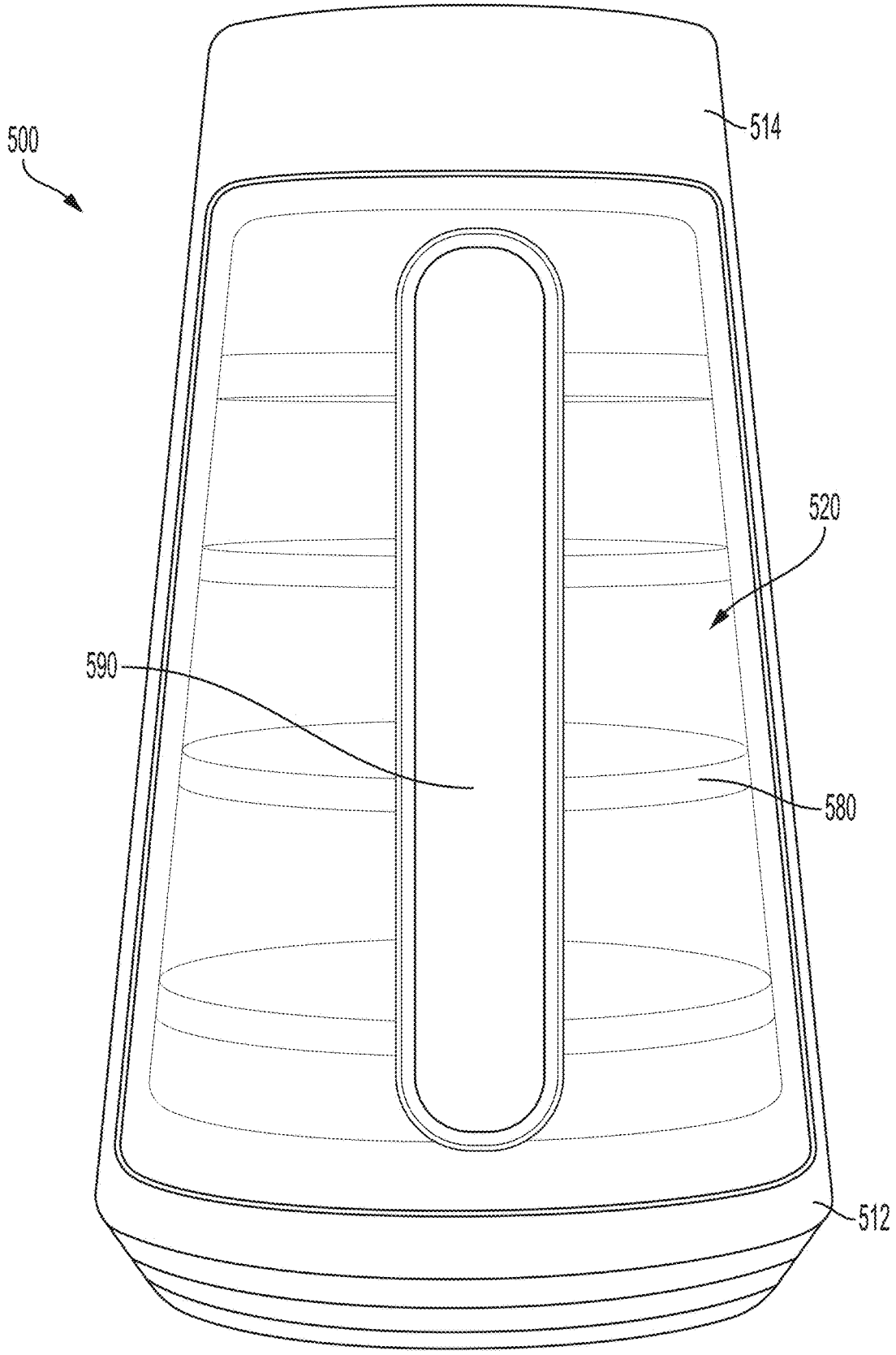
FIG. 16 shows a perspective view of a vacuum-insulated glass cooler according to an embodiment.

In some embodiments, cooler 500 may have a frustoconical shape, as shown in FIG. 16. Thus, cooler 500 has a circular transverse cross sectional area, and housing 510 of cooler 500 tapers from a lower end 512 toward an upper end 514. Similarly, storage compartment 520 may taper from a lower end toward an upper end thereof. Housing 510 may include curved and transparent outer panels that are arranged exterior to storage compartment 520. Storage compartment 520 may further include a door for providing access to storage compartment 520. Door may be shaped so as to form a portion of the frustoconical housing 510. Shelves 580 within storage compartment 520 may also have a circular shape, wherein shelves 580 decrease in diameter from a lower end 512 toward an upper end 514 of cooler 500. Shelves 580 may be supported on a central shelf support, similar to the embodiment described with respect to FIG. 14. Cooler 500 may also include a digital display 590 arranged on housing 510 for displaying information and advertisements to consumers. Digital display 590 may be arranged on an outer panel of housing 510. Digital display 590 may have an elongated shape that extends from a lower end 512 toward an upper end 514 of housing 510 on a first side of housing 510.

Figure 17:
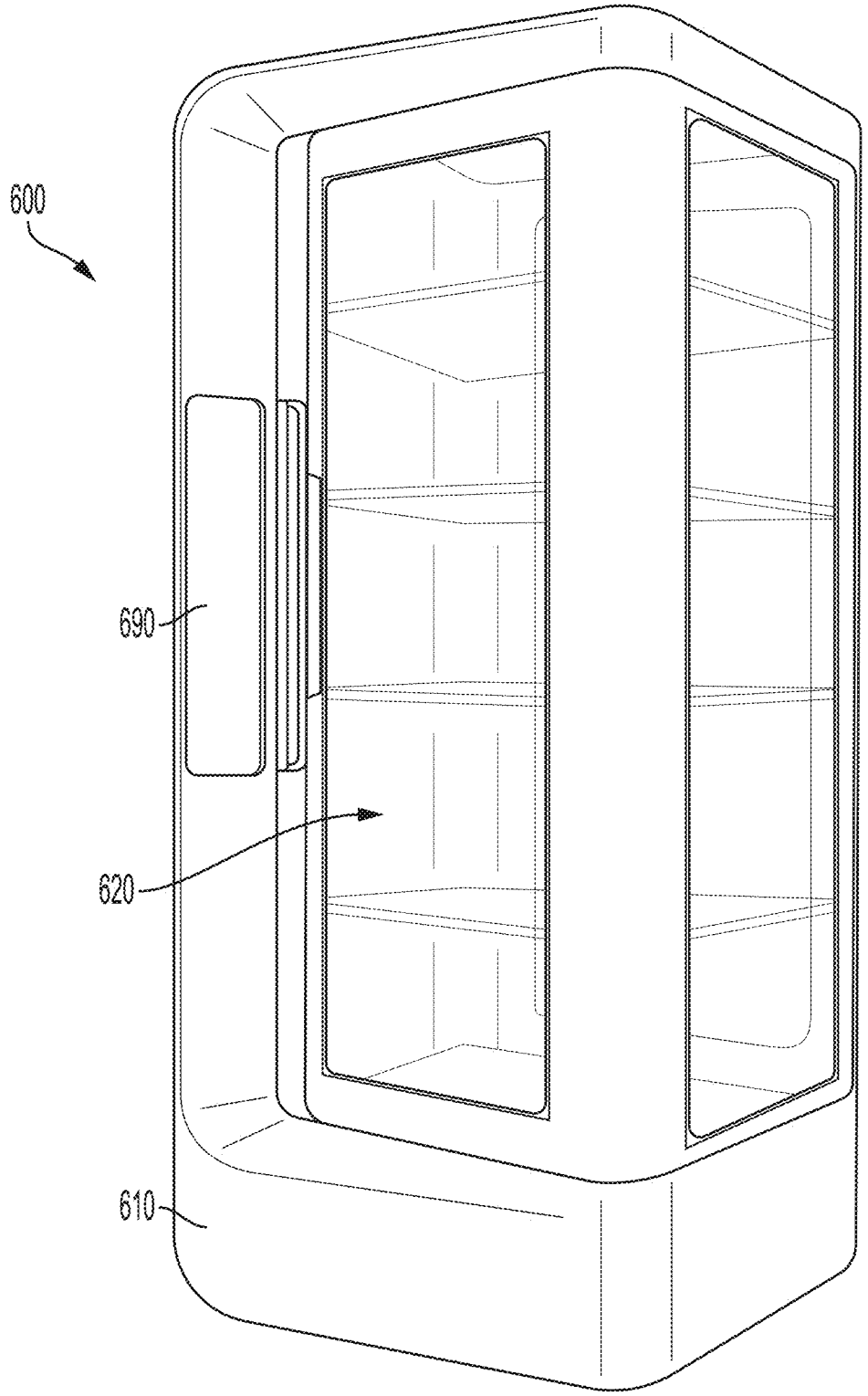
FIG. 17 shows a perspective view of a vacuum-insulated glass cooler according to an embodiment.

In some embodiments, cooler 600 may have a storage compartment 620 with a different shape than a shape of housing 610, as shown for example in FIG. 17. Storage compartment 620 may have a square or rectangular transverse cross sectional area, whereas housing 610 includes a transverse cross sectional area that is trapezoidal, such that a portion of housing 610 extends outwardly from storage compartment 620. Storage compartment 620 includes one or more vacuum-insulated glass panels to provide thermal insulation while allowing products within storage compartment 620 to be visible to consumers. Cooler 600 may include a digital display 690 for displaying information and advertisements. Digital display 690 may be arranged on a portion of housing 610 that extends outwardly from storage compartment 620. Alternatively, digital display 690 may be arranged on an outer panel of housing 610.

Figure 18:
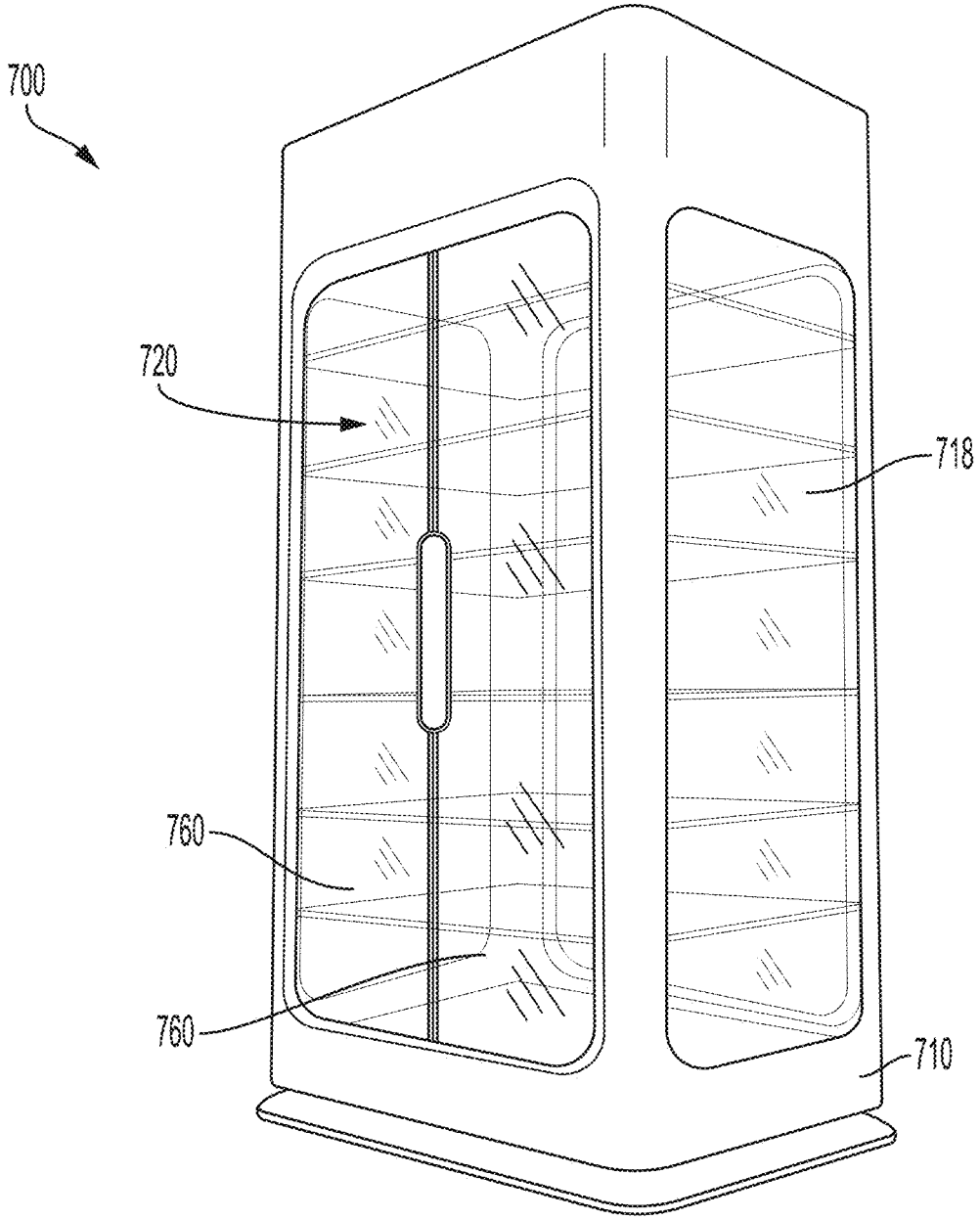
FIG. 18 shows a perspective view of a vacuum-insulated glass cooler according to an embodiment.

In some embodiments, cooler 700 may have two doors 760, as shown for example in FIG. 18. Cooler 700 may be formed as a rectangular prism, and may include multiple doors 760 for accessing products within storage compartment 720. A pair of doors 760 may be arranged on a first side of housing 710, such that a first door 760 is arranged on a left side and a second door 760 is arranged on a right side of the first side of housing 710. When doors 760 are closed, the doors 760 are coplanar. Cooler 700 may include transparent outer panels 718 on the sides of cooler 700 perpendicular to doors 760 so that products can be viewed from one or both sides of cooler 700. Further, a rear side of cooler 700 arranged opposite doors 760 may also include a transparent outer panel. Cooler 700 may include a digital display for displaying information and advertisements to consumers.

Figure 19:
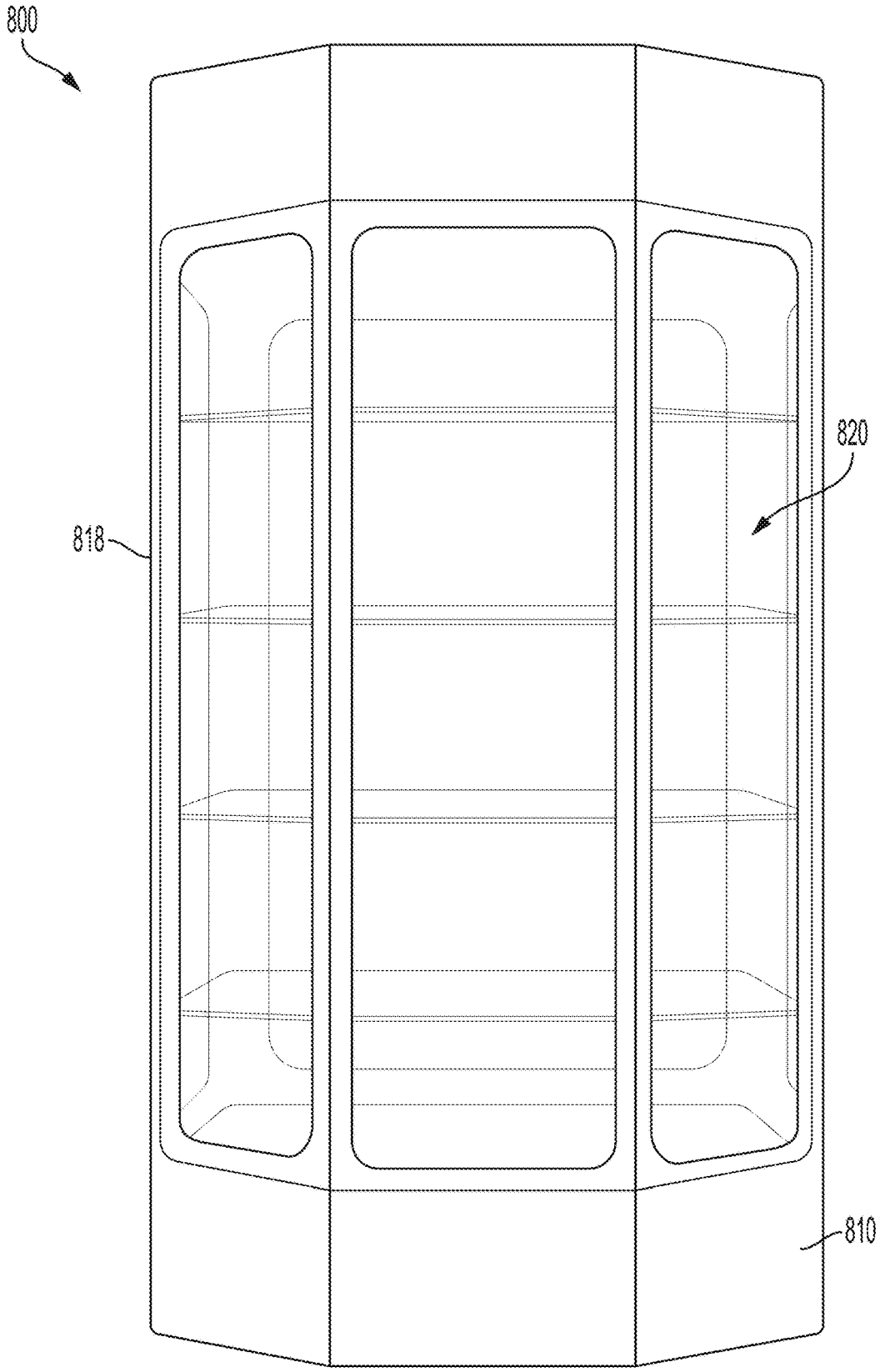
FIG. 19 shows a perspective view of a vacuum-insulated glass cooler according to an embodiment.

In some embodiments, cooler 800 may have a transverse cross sectional shape that has five or more sides, and thus may be a pentagon, hexagon, heptagon, or octagon, among others, as shown for example in FIG. 19. Cooler 800 includes a storage compartment 820 that includes vacuum-insulated glass panels. Housing 810 of cooler 800 may include one or more outer panels arranged exterior to storage compartment 820, wherein outer panels are transparent so as to allow consumers to view products from multiple sides of cooler 800. Cooler 800 may include a rear side, a left and right side, and a front side that is divided into three angled portions, such that cooler 800 is formed as a pentagon. Each of the angled portions of cooler 800 may include a transparent outer panel 818. Further, a post of housing 810 may separate each transparent outer panel 818 so as to provide support to the outer panels 818.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

What is claimed is:

1. A vacuum-insulated cooler, comprising:
a housing comprising:
a base;
an upper end;
a post extending from the base to the upper end;
a door outer panel comprising a transparent material; and
a first outer panel and a second outer panel each extending between the base and the upper end, wherein the first outer panel is secured to the post; and
a storage compartment enclosed by the housing for storing products, wherein the storage compartment comprises:
a lower wall;
an upper wall;
a plurality of sidewalls extending from the lower wall to the upper wall, wherein each of the plurality of sidewalls comprises vacuum-insulated glass, and wherein a first sidewall of the plurality of sidewalls is connected to a second sidewall of the plurality of sidewalls by a seal;
wherein the first outer panel is arranged spaced from and exterior to a first sidewall of the plurality of sidewalls, and wherein the second outer panel is arranged spaced from and exterior to a second sidewall of the plurality of sidewalls; and
a door for providing access to the products within the storage compartment, wherein the door comprises:
a vacuum-insulated glass panel having a first glass panel spaced from a second glass panel by a gap, wherein the gap comprises a vacuum, and
a frame that supports the vacuum-insulated glass panel; and
wherein the door outer panel is spaced apart from the vacuum-insulated glass panel of the door, and the frame supports the door outer panel.

2. The cooler of claim 1, wherein the vacuum-insulated glass of each of the plurality of sidewalls comprises a first panel separated from a second panel by a gap, wherein a vacuum is formed in the gap between the first panel and the second panel.

3. The cooler of claim 2, wherein spacers are positioned in the gap between the first panel and the second panel to maintain separation of the first panel and the second panel.

4. The cooler of claim 1, wherein the plurality of sidewalls of the storage compartment do not include foam insulation.

5. The cooler of claim 1, wherein a first sidewall of the plurality of sidewalls has a convex curvature.

6. The cooler of claim 1, wherein the seal comprises a first channel to receive the first sidewall and a second channel to receive the second sidewall.

7. The cooler of claim 1, wherein the post is integrally formed with the base of the housing.

8. A vacuum-insulated cooler, comprising:
a housing comprising:
a base;
an upper end;
a post extending from the base to the upper end; and
a curved outer panel comprising a transparent material, wherein the curved outer panel is secured to the post and to the base; and
a storage compartment enclosed by the housing for storing products, wherein the storage compartment comprises:
a lower wall;
an upper wall;
a first sidewall extending from the lower wall to the upper wall, and a second sidewall extending from the lower wall to the upper wall, wherein the first and second sidewalls each comprise vacuum-insulated glass, wherein the vacuum-insulated glass comprises a first glass panel and a second glass panel separated by a gap, wherein the gap comprises a vacuum such that the products within the storage compartment are visible through the first sidewall and the second sidewall of the storage compartment;
wherein the post is arranged exterior to the storage compartment, and wherein the curved outer panel is arranged spaced from and exterior to the first sidewall of the storage compartment; and
a first door for providing access to the products within the storage compartment.

9. The cooler of claim 8, further comprising a second door for providing access to the products within the storage compartment.

10. The cooler of claim 8, wherein the lower wall comprises a first vent and the upper wall comprises a second vent, and wherein the cooling unit circulates cooled air into the storage compartment through the first vent and the second vent.

11. The cooler of claim 8, wherein the storage compartment comprises shelves, and wherein each of the shelves comprises a transparent material.

12. A vacuum-insulated cooler, comprising:
a housing comprising:
a base containing a cooling unit;
an upper end;
a post extending from the base to the upper end; and
a plurality of outer panels, wherein each of the plurality of outer panels comprises a transparent material; and
a storage compartment enclosed within the housing for storing products, wherein the storage compartment comprises:
a lower wall;
an upper wall comprising a vent, wherein the vent is in communication with the cooling unit via a conduit extending through the post;
a plurality of sidewalls extending from the lower wall to the upper wall, wherein a first sidewall of the plurality of sidewalls comprises vacuum-insulated glass comprising a first glass panel spaced from a second glass panel by a gap, wherein the gap comprises a vacuum;

wherein the plurality of outer panels are exterior to the plurality of sidewalls; and a door for providing access to the products within the storage compartment.

13. The cooler of claim 12, wherein the post supports the storage compartment.

14. The cooler of claim 12, further comprising a digital display arranged on a first outer panel of the plurality of outer panels.

15. The cooler of claim 12, wherein the transparent material of the plurality of outer panels comprises polycarbonate.

* * * * *